US007500673B2

(12) United States Patent
Arias, III

(10) Patent No.: US 7,500,673 B2
(45) Date of Patent: Mar. 10, 2009

(54) DUAL GAME WITH CHESS

(76) Inventor: Frank Arias, III, 2001 S. Haster St., Apt. 24B, Anaheim, CA (US) 92802

( * ) Notice: Subject to any disclaimer, the term of this patent is extended or adjusted under 35 U.S.C. 154(b) by 31 days.

(21) Appl. No.: 11/879,965

(22) Filed: Jul. 19, 2007

(65) Prior Publication Data

US 2009/0020949 A1 Jan. 22, 2009

(51) Int. Cl.
*A63F 1/00* (2006.01)

(52) U.S. Cl. ..... 273/260; 273/255

(58) Field of Classification Search ..... 273/255, 273/260, 261, 262

See application file for complete search history.

(56) References Cited

U.S. PATENT DOCUMENTS 3,684,287 A * 8/1972 Welter ..... 273/260

2008/0023914 A1* 1/2008 Locke ..... 273/242

* cited by examiner

*Primary Examiner*—Vishu K. Mendiratta
(74) *Attorney, Agent, or Firm*—Maria Erlinda Co Sarno

(57) ABSTRACT

A combination of a chess game and a card game provides a more challenging game not achievable by playing only the chess game or only the card game. The cards in the card game are laid on the chessboard face down and both games are played simultaneously with some changes made to make the two games adoptable to each other without departing too much from the known rules of the game. Two players take alternate turn on the chess game. A capture of a chess piece or a landing of a chess piece at a designated square and territory on the chessboard triggers an action on the card game. The game ends with a checkmate, a draw, or when a certain points are garnished by a player on the card game.

21 Claims, 5 Drawing Sheets

DUAL GAME WITH CHESS

This invention relates to a method of combining a chess game with another game to remove the advantage of skilled chess players over the novice, make the chess game more challenging, and allow the game to terminate at a shorter time with a winner without waiting for a checkmate or a draw, thereby attracting more people to play the game. Combining the chess game with another game catered to different age level makes this an exciting game for all ages.

BACKGROUND

It is widely accepted that the game of chess enhances the mental development of a player. Consequently, some schools are offering this game as an after school program. However, acceptance and offering of this program are not widespread because of the length of time it takes to finish a game. Because of this, the players often do not start a game when there is a constraint in time because often times, a winner is declared merely because that player has captured more chess pieces, consequently, more chess points than the other player. This does not necessarily reflect the true winner because a player's strategy may be to sacrifice chess pieces at the start of the game in order to undertake the moves contemplated for a good checkmate. In this era where everything seems to be directed on how to make things faster and easier, the game of chess has become less popular despite of the benefit it provides in mentally developing the players.

The claimed invention proposes to solve the above problem by combining the game of chess with another game, preferably a card game. The other game can be any game that employs outscoring an opponent. With the combination of another game, that is, a game simultaneously played with the chess match, the game becomes more challenging, less predictable in outcome and offers more options in establishing by mutual agreement or by playing the rules of the other game when the game terminates without waiting for a check mate or a draw. The chess game employs the chess pieces and uses a chess board and the other game uses the cards normally used for playing the card game.

The game of 'rock-paper-scissors' is the first game illustrated here as an example for a game that can be played with the chess game because it is especially suited for children who are at the right age of learning and playing the game of chess. Other card games of varying level of complexity or challenge are shown as examples which can be used instead of the rock-paper-scissors game to cater to the adult players.

Variants of a chess game have been developed but none of these combine the game of chess with another game. Some of these known variants, like the variants proposed here, can be played with the claimed invention if combined with another game. The claimed invention lies in the simultaneous playing of a chess game with another game which causes a player not only to learn and use the rules of each game but how to win both games simultaneously, as well. Consequently, the chess game becomes more mentally challenging. The combination of the chess game with another game can also appeal to skilled chess players because of a different challenge faced by the seasoned player. Because of the long history of chess, many chess strategies became well-known and outcomes became more predictable. The skilled player also has an edge over the novice players, causing the novice players to play only with peers of the same level thereby slowing the advancement that can be derived by playing one with more advanced skills. Playing two games simultaneously tries to even out the playing field which should encourage a novice to play with a more skilled player and vice versa.

It is an object of this invention to provide a game that offers more challenges by combining a chess game with another game.

It is also an object of this invention to encourage one to learn to play and win the game of chess without being hindered with the requirement to finish a game.

It is likewise an object of this invention to provide another method for winning or terminating a chess game aside from a check mate or a draw.

It is a further object of this invention to make the chess game more appealing to all ages.

It is also a further object of this invention to provide a game that can have different or the same winner, by the rules of the chess game or by the rules of the other game or by both.

SUMMARY OF THE INVENTION

This invention combines a chess game with a card game to add more challenge and excitement to an history old chess game. The combined chess and card game, comprises the general steps of: a) laying a conventional chess piece on each designated squares of a chessboard, the conventional chess pieces including 8 Pawns, a pair of Rook, a pair of Knight, a pair of Bishop, a Queen and a King; b) designating four horizontal rows of squares on the chessboard proximal to a first player as player's territory; c) designating remaining four horizontal rows of squares on the chessboard proximal to a second player as opponent player's territory; d) shuffling a deck of cards of the card game; e) placing 24 cards of the card game face down on the chessboard by each player on three horizontal rows of squares at each player's territory, leaving a row of squares most proximate to each player without a card, a row of Pawns having a card underneath each chess piece; f) leaving at least two unrevealed cards out of the chessboard by each player, each player keeping extra cards unrevealed as held cards; g) simultaneously playing the game of chess and the card game with each player alternating turns; h) taking a destination card, the card on a destination square at opponent player's territory landed by a chess piece after a move on the chess game by a player, the player not taking destination cards landed at player's own territory; i) playing the chess game until a chess piece is captured, the capturing player substituting opponent player's chess piece with capturing player's chess piece and placing the captured chess piece at capturing player's score box; j) taking the card underneath the captured chess piece at opponent player's territory as a captured card if a card is present; k) resuming the game after the capture; l) treating the destination card differently from the captured card; m) capturing as much chess pieces by each player to win the chess game; n) outscoring an opponent player on the card game to garnish more points; and, o) ending the game by winning the chess game on a checkmate or terminating the chess game with a draw or attaining the winning score or points on the card game, the winner on the draw given to the player with more points on the card game.

The rock-paper-scissors game and the Lucky Nine game are played almost identically except that the rock-paper-scissors game is played with a different sets of cards. The Lucky Nine game is played with a standard set of playing cards. In the above card games, the destination card from step h) is taken unrevealed as an additional held card for replacing a beating card, the card placed at a player's designated pit spot of a challenge board, when the beating card was used to beat the captured card. When a player has ran out of held cards to replace a beating card at player's designated pit spot, the player also waits to get these destination cards to replenish a player's held cards. The beating cards comes originally from the extra unrevealed cards after each player places 24 cards at their respective territories on the chessboard and these are the cards used by the players to beat the captured card taken underneath a chess piece which is placed face up at a central spot on the challenge board. The captured card is discarded when both players do not have a beating card that would beat the captured card. The number on the captured card and not the number on the beating card is the points attained by the beating player. A challenge board is a separate board from the chessboard where the card game activity of beating, betting, etc. takes place which has a central spot and pit spots for each player. In the card game, one player outscores another player by beating as many captured cards placed at the central spot of the challenge board with a beating card of the same or higher points taken from a beating player's designated pit spot. The captured card whose points are the ones that get into the score of a player are place on the beating player's score box. To make the card game more challenging, the players may decide to use more than one deck of cards, either using all sets or a portion of the decks of cards. A deck of cards as used herein comprises a complete set of cards from one deck of cards or several portions from several decks of cards combined to form the deck of cards actually used in the game. The rock-paper-scissors game comprises a set of twenty Rock cards, a set of twenty Paper cards, and a set of twenty Scissors cards, each set of twenty cards consecutively numbered from one to twenty corresponding to the points of each card with additional three Wild cards each having a point of 21 and a Trump card having a point of 22 are added to the 60 cards of Rock, Paper ans Scissors cards for an advanced rock-paper-scissors game. The Lucky Nine card game and the No Limit Texas Hold 'Em Poker Game are played with a standard deck of playing cards, comprising of four suits (spades, hearts, clubs and diamonds) of thirteen cards each, with each suit including one ace, one king, one queen, one jack, one ten, one nine, one eight, one seven, one six, one five, one four, one three, and one two.

The chess game will get more popularity among adults if combined with a poker game. The poker game illustrated is a two player No Limit Texas Hold 'Em poker game adopted to be played with the chess game. This will be referred to simply as poker game. As in the conventional poker game, each player places a minimum bet on a pot at a poker board after each player has seen their unrevealed held cards but before any community card is revealed on the poker board. The card game being a poker game, slightly differs from the rock-paper-scissors and the Lucky Nine game only because the rules of the poker card game is different. The general rules pertaining to the method on how the chess game is combined with the card game is the same. To play the poker game, the introduction of community cards to make up a poker hand and the round of betting to capture points in the form of chips requires additional detailing steps. As stated above, the destination card and the captured card, although obtained in the same manner as in any other chess and card game, have different roles in the poker game. The treatment in the poker game is reversed. The destination card is the one placed face up on the board while the captured card becomes initially an unrevealed card which is subsequently revealed when placed face up as a community card on the poker table. In the poker game, the destination card from step h) is placed face up at the poker board as a community card, one-by-one after a qualifying chess move as the game progresses until a maximum of five community cards are in the poker board. Any additional destination cards obtained when five community cards are already on the poker table is discarded. A qualifying chess move means a move by a chess piece to a designated square on the chessboard without capturing an opponent's chess piece. A round of betting occurs after each community card is placed on the poker board. The captured card of step j) is initially treated as a held card. These become the two held cards or one of the held cards when the players have less than two held cards, it can also replace an unrevealed weak held card, with the weak held card placed on the poker table by the player as a community card, or it can be placed as a community card without replacing a held card after the player has seen the destination card. A round of betting is conducted after every community card is placed face up on the poker table until four community cards are placed face up and this is started by the player placing the community card. The betting process starts with the player betting with a check, bet, fold or all-in and opponent player responding to the bet with a check on the bet of check, a fold, a call, a raise or all-in, the bet of check available only when no bets, compulsory or voluntary has taken place. The poker game resumes as long as players have chips to play and two unrevealed cards as held cards. The different types of bets are as follows: a bet of all-in bets or wagers chips equivalent to all of opponent player's chips or points or all of player's chips or points; a bet wagers an agreed upon minimum bet; a raise increases the number of points or chips bet by opponent player; a call matches an opponent player's bet; and, a fold results in opponent taking all chips at a pot on the poker board with all held cards and community cards discarded. When a bet of all-in is not responded by a fold, all held cards should be revealed and with all five community cards on the poker table, the player with a higher hand is determined based on a ranking of a poker hand. Each poker hand comprises two held cards and five community cards. The player with the higher hand takes all the chips at the pot. The ranking of the poker hand follows the conventional ranking of royal flush, straight flush, four of a kind, full house, flush, straight, three of a kind, two pair, one pair, and high card in descending order. However, a bet of all-in responded by a fold does not require the player betting all-in to reveal his/her held card. When a player folds, the held cards along with the community cards are discarded. The game of poker resumes only after the two players have two held cards in their hands and the first player who completes his/her two held cards by taking captured cards underneath captured chess pieces at opponent's territory starts the round of betting. Unlike conventional poker, here, a player is not allowed to re-raise when opponent player responds by a raise. Outscoring an opponent in the poker game is done by having as many winning five card poker hand when the round of betting takes place. Attaining the winning score or points on the poker card game is getting all of opponent player's chips.

To add further challenge and remove the advantage of veteran chess players, it is proposed to replace a Pawn chess piece with a Frog chess piece. The Frog chess piece moves and captures like a Pawn and moves forward but not backwards like a Knight until the Frog is converted to a Knight. Once converted to a Knight, it can then move and capture as a Knight. The Frog does not convert to any other chess piece except for a Knight when the Frog lands at any square of the chessboard along the row most proximate to the other player at opponent player's territory. Another modification to the chess game is to replace a Knight chess piece with an Archer chess piece, the Archer chess piece moving like a Knight or one spot diagonally sideways but capturing only like a Rook. To make the game not too complex, only one Frog is recommended to replace one Pawn and only one Archer is recommended to replace one Knight.

In a game where the players compete and take alternate turns in playing the game, it is to be appreciated that the players also alternate in designation as player and opponent player. A first player can become an opponent player or the other player in relation with the second player and vice versa. The detailed description has done its best to clarify the steps of the game and make the use of these terms less confusing as possible.

The above chess and card games can be easily played everywhere because a game set can be packaged in a portable manner, just like the many card games in the market. A game set for use herein on the chess game with chess adopted card games for a Rock-Paper-Scissors game, a Lucky Nine card game and a No Limit Texas Hold 'Em poker card game, comprises: a chessboard having a score box for each player; two sets of chess pieces, each set including 8 Pawns, a pair of Rook, a pair of Frog, a pair of Archer, a pair of Knight, a pair of Bishop, a Queen and a King of one color or design and 8 Pawns, a pair of Rook, a pair of Frog, a pair of Archer, a pair of Knight, a pair of Bishop, a Queen and a King of another color or design; a deck of rock-paper-scissors cards comprising a set of twenty numbered Rock cards, a set of twenty numbered Paper cards, and a set of twenty numbered Scissors cards, with additional three numbered Wild cards and a numbered Trump card; a deck of standard playing cards, comprising of four suits (spades, hearts, clubs and diamonds) of thirteen cards each, with each suit including one ace, one king, one queen, one jack, one ten, one nine, one eight, one seven, one six, one five, one four, one three, and one two; a challenge board flipping over to a poker board, the challenge board having a central spot and a pit spot and the poker board having a designated space for a pot and community cards; chips for the poker game; and, instruction manual for the game.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION OF THE INVENTION

Figure 1:
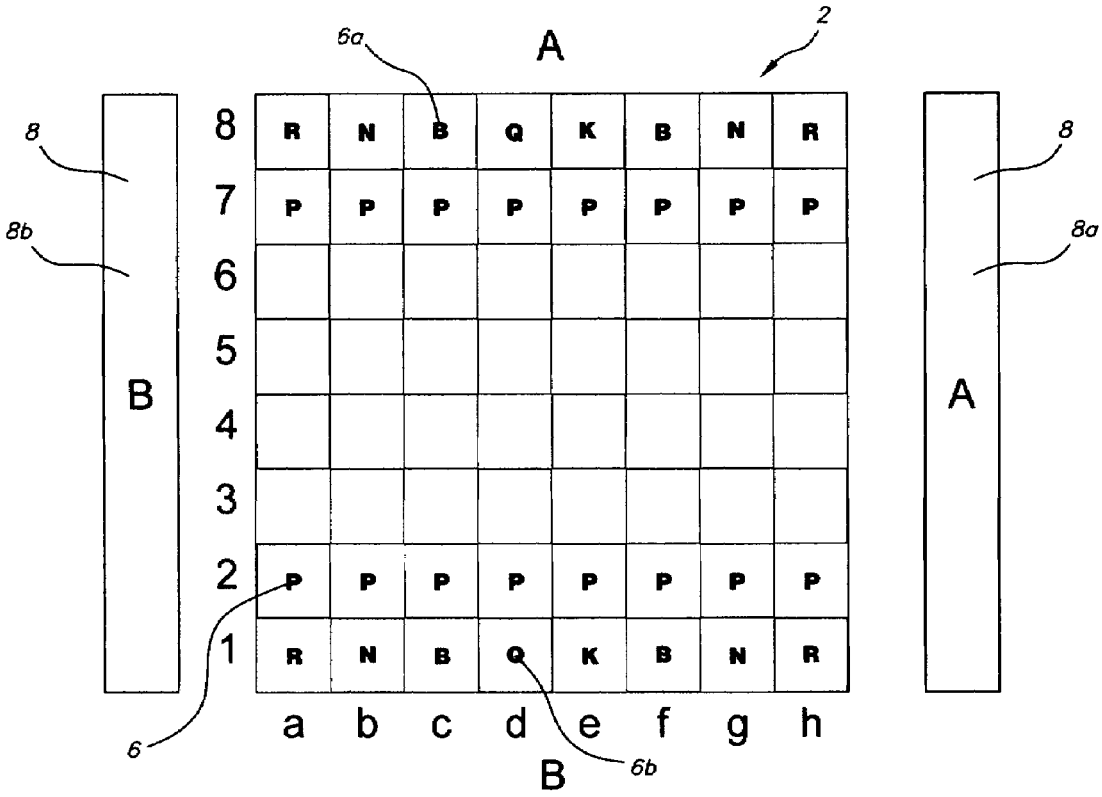
FIG. 1 is a plan view of a chessboard with the chess pieces identified by letters instead of figures including a score box for each player.

The detailed description represented herein is not intended to represent the only way or the only embodiment in which the claimed invention may be practiced. The description herein is provided merely as an example or examples or illustrations of the claimed invention and should not be construed as the only way or as preferred or advantageous over other embodiments or means of practicing the invention. Any game combining the game of chess with a card game played simultaneously as a single game is within the scope of this invention. The detailed description includes specific details to provide a thorough understanding of the claimed invention and it is apparent to those skilled in the art that the claimed invention may be practiced without these specific details.

The combination chess and card game follows the general steps of laying a chess piece on each designated squares of a chessboard; designating four horizontal rows of squares on the chessboard proximal to a first player as player's territory; designating remaining four horizontal rows of squares on the chessboard proximal to a second player as opponent player's territory; shuffling a deck of cards of the card game; placing 24 cards of the card game face down by each player on three horizontal rows of squares at each player's territory, leaving a row of squares most proximate to each player without a card, with a row of Pawns having a card underneath each chess piece; placing at least two cards face down by each player on each player's designated pit spot of a challenge board, each player keeping extra unrevealed cards as held cards; simultaneously playing the game of chess and the card game with each player alternating turns; taking a card from a destination square at opponent player's territory landed after a move on the chess game by a player, the player not taking a destination card at player's territory; playing the chess game until a chess piece is captured, the capturing player substituting opponent player's chess piece with capturing player's chess piece and placing the captured chess piece at capturing player's score box; taking the card underneath a captured chess piece at opponent player's territory; resuming the game after the capture; treating the destination card differently from the captured card; capturing as much chess pieces by each player to win the chess game; outscoring the opponent player on the card game to garnish more points; and, ending the game by winning the chess game on a checkmate or terminating the chess game with a draw or attaining the winning score or points on the card game, the winner on the draw given to the player with more points on the card game.

The basic combination chess and card game first illustrated here is the conventional chess game using the conventional chess rules and chess pieces combined with a card version of the "rock-paper-scissors" game, herein also referred to as rps game, that is universally known to children especially those of elementary school age. The rules of the conventional chess game is published in several encyclopedias or one is directed to Just. T and Burg, D., *USCF's Official Rules of Chess,* $5^{th}$ edition. The rps game is chosen as an example here because this will make the learning of the chess game more appealing for children under the ages of seven when they develop their abstract thinking as well as their desire to compete with other children. For better understanding of the proposed game, the rules of the conventional game of chess as well as the rules of the "rock-paper-scissors" game as adopted into a card game will be briefly described. When not specifically detailed here or the changes mentioned, the conventional rules of the chess and the rps game applies.

The conventional game of chess is a game of skill for two players alternating turns, played upon an eight-by-eight square, checkered game board, hereinafter, chessboard, having sixty-four alternating dark and light colored squares comprising eight horizontal rows, and eight vertical columns as shown in FIG. 1. Since the players alternate turns, the player at one turn becomes the opponent player at the other turn. The game consists of the six familiar types of pieces with their accepted modes of movement. The king moves any direction (horizontally, vertically, or diagonally) one square at a time. The rook moves in a straight direction (vertically or horizontally) any number of squares. The bishop moves diagonally any number of squares. The knight moves in "L-shape," two squares in one straight direction, then one square orthogonally. In the conventional game, this piece alone can jump, or leap, over an intervening piece. The queen has a choice of movement like either a bishop or a rook in one turn (e.g. horizontally, vertically, or diagonally). The pawn moves one square forward, with the option of two squares before it has been moved once. The pawn captures diagonally, whereas the other pieces capture in their ordinary movement. A pawn can become any chess piece once it reaches the row of eight squares at the other or opponent player's territory, most proximate to the other player. Other player when used, also refers to who the opponent player is at the particular turn of play. The moves are through unobstructed squares only that is, on squares without a chess piece, except for the knight as stated above. The intervening chess piece(s) over which a knight leaps over is not a captured chess piece and is left in its place. A capture removes one of opponent player's chess piece from play or from the chessboard, and thus no two pieces occupy the same square at the same time. The castling move transposes a player's king and rook. Over unoccupied and unthreatened squares, the king is moved two squares horizontally, right or left, toward a rook, and that rook is moved over the king to the adjacent square. Differences on the rules occur on stalemate, pawn promotion, and the pawn en passant rule which can be agreed upon between players prior to the game.

Each player has sixteen movable chess pieces identified with the letters between parenthesis: one King (K), one Queen (Q), two Rooks (R), two Bishops (B), two knights (N) and eight Pawns (P). These are laid at their designated squares on the chessboard as shown in FIG. 1. The chess pieces are initially located on two horizontal rows of the rectangular chessboard that are disposed most proximate to each of the two players' edges. Each player's chess pieces are positioned in a predetermined opposed, mirrored relation to his or her opponent's pieces. The players alternate turns during the game, which consist of moving one of the player's pieces to a different square on the chessboard according to their mode of movement. The first player who makes the move can be agreed upon or it can be determined by chance such as by roll of each player's dice, with the player's dice having the higher number starting the move. In this manner, a player with either the light or dark colored chess pieces can start the game. However, the players can also start the game in the conventional way wherein the player who correctly guessed in what hand the light colored chess piece is, starts the game. The latter way of determining who makes the first move further diminishes the advantage of the skilled chess player. A player captures the opponent player's chess piece during a turn by moving his or her piece into a square occupied by one of the opponent player's chess pieces. Herein, unlike a conventional chess game, a player can win without waiting until one player checkmates the opponent player's king, that is, a king is checkmated if the king cannot successfully move out of a check, where it is threatened with capture.

Figure 2:
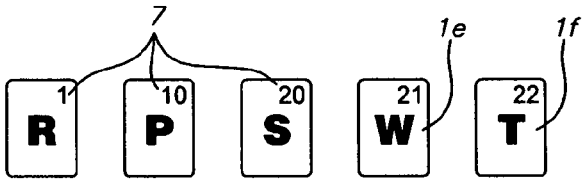
FIG. 2 shows a front plan view examples of the rock-paper-scissors cards.
Figure 2A:
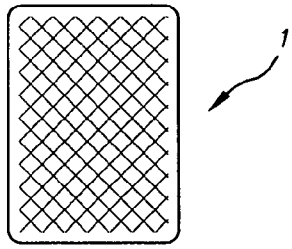
FIG. 2A shows an example of a back plan view of a card.

The rules of the "rock-paper-scissors" game has been adopted and modified into a card game to enable this game to be combined with the chess game. On the basic rps card game, the deck of cards used has three sets of twenty (20) cards. One set of twenty are labeled with R to stand for Rock. These twenty cards are also numbered consecutively from 1 to 20, recommended to be written on one corner of the card for ease of reading. Another set of twenty (20) cards are uniformly labeled with P to stand for Paper. Likewise, these cards are numbered consecutively from 1 to 20. A third set of twenty (20) cards are uniformly labeled with S to stand for Scissors. Likewise, these cards are numbered consecutively from 1 to 20. Each label (letter) on the card is equivalent to a suit of a standard playing card. The color for the label R, P, and S and their respective numbers can be of the same color but designating one color for each label or suit and their respective numbers is preferred for ease of association. The rps accompanying game can be played with one deck of 60 cards as described above or with each player having their individual deck of cards. The deck of cards from each player used for the ips game should be identical, that is, of the same color for the label (letters) and the numbers to make them indistinguishable when two or more decks of cards are combined before shuffling and distribution. Two decks or more are usually played at a more advanced game. If there is only one deck of cards, all 60 rps cards are played. The 60 cards are shuffled and each player gets 30 cards. If each one has their own individual deck of cards, each player chooses 30 of the 60 cards to play. The set aside 30 cards are never opened and do not get into the game. Each 30 rps cards contributed by each player are combined to form the deck of cards that will be actually used in the game and this is shuffled. After shuffling, each player is given 30 cards. FIG. 2 shows three examples of the cards, a Rock card numbered 1; a Paper card numbered 10; and a Scissors card numbered 20. From these examples, one can envision how all 60 cards would look like. As universally known, a Paper beats a Rock, a Scissors beats a Paper while a Rock beats a Scissors. Additionally, in the card adopted rps game here, a Rock card with a number 1 will lose against another Rock card with a greater number, here, a Rock card with any number greater than one. The same is true for the other rps cards. If two decks of cards were used, a card with the same label and number will beat another card of the same label and number. If a Paper card is used to beat a Rock card, the Paper card need not have a higher number than the Rock card. The same is true when the Scissors beat a Paper card and when the Rock beats a Scissors card. Of course, the game can be made more complex by requiring both the label and the number on the beating rps card to be superior to the rps card being beaten.

Figure 3:
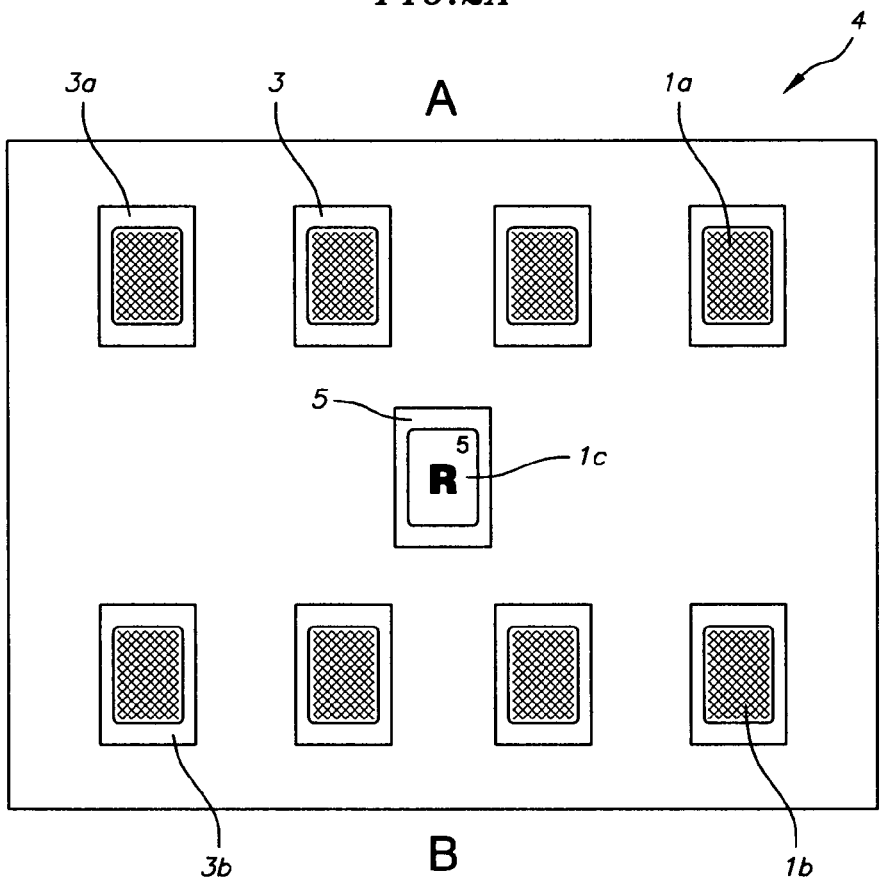
FIG. 3 is a front plan view of a challenge board.

The card adopted "rock-paper-scissors" game has a challenge board shown in FIG. 3 which accompanies the deck of rps cards. This challenge board can be used for other card games. In the challenge board, there is a central spot, a square or a rectangle and on the top and below the central spot are two to four spots of squares or rectangles referred to herein as pit spots. Each player has his/her own pit spots and these are the square or rectangles most proximate to the player.

Figure 4:
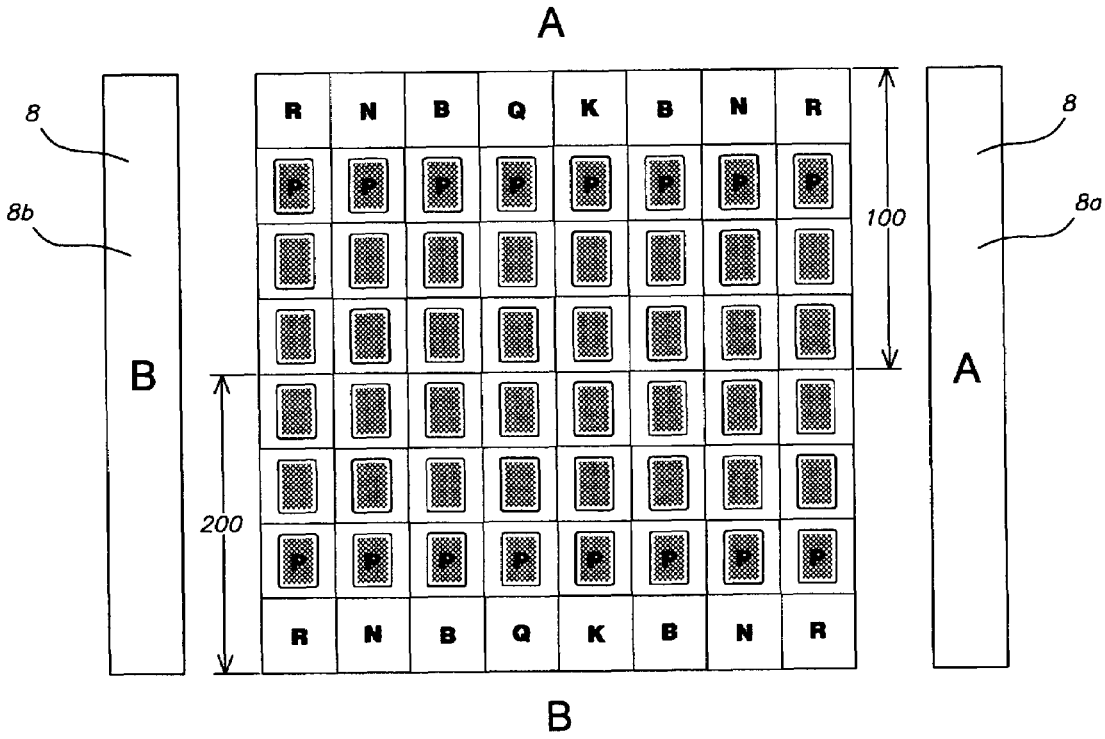
FIG. 4 is a front plan view of a chessboard showing the position of the cards underneath the chess pieces.

In the chessboard 3, the four horizontal rows of squares proximal to one player defines that player's territory, 100, while the other four horizontal rows of squares proximal to the other player defines that player's territory 200 also referred to as opponent player's territory. Each player's 24 of the 30 rps cards 1 are laid face down on the three rows of eight squares of the chessboard 2 proximal to each player, leaving the row of eight squares most proximate to each player clear of rps cards as shown in FIG. 4. At the start of the game, as shown, only the rows of Pawns (P) have an rps card 1 underneath. The players can agree on whether the 24 of the 30 rps cards will be laid randomly on the respective squares of the chessboard 2 or intentionally picked by the respective players and laid on the chessboard based on a strategy of the player. Each player retains six (6) cards 1 of the 30 rps cards in his/her hand, at least two of which is laid face down at his/her pit spot 3 on the challenge board 4 with the remaining rps cards held unrevealed by the player for replacing a beating card at his/her respective pit spot at the challenge board. Since there are six held cards, each player can place four cards at the pit spot instead of two. A beating card means one of the cards at the pit spot 3 that has been used or removed from the pit spot to beat a captured card placed at the central spot 5. A player is allowed to see his or her own unrevealed rps cards placed on the pit spot of the challenge board 4. Once each player chooses and puts his/her rps cards on the challenge board, these can not be substituted.

A player starts a chess match by agreement or by roll of dice as stated above. Just to add clarity, the rps cards 1 and the chess pieces 6 of one or first player will be labeled with "a" for player A while the other chess pieces 6 and rps cards 1 will be labeled with "b" for the second player B. Player A's territory herein is 100 while player B's territory herein is 200. Player B is also referred to herein as opponent or other player in relation to Player A. At the first instance when player A captures a chess piece 6*b* of the opponent or the other player B on the chessboard 2 at B's territory, the capturing player A substitutes the chess piece 6*b* of the captured player B with the capturing chess piece 6*a*. If the chess piece captured at the captured player's territory 200 has an rps card underneath, the capturing player A removes the card 1*b* underneath the chess piece 6*b* of the captured player. The card 1*b* underneath the captured chess piece 6*b*, herein referred to as captured card 1*c*, is placed face up at the center spot 5 of the challenge board 4 of the rps game. If card 1*c* taken underneath the chess piece is Rock 5, the capturing player A is given the chance to get the points on the card, 5 points in this example, by looking at the four faced down cards 1*a* placed at his/her pit spot 3*a* on the challenge board 4 proximal to his or her position and taking the card 1*a* that would beat the captured card 1*c* at the central spot 5, here shown as Rock 5 on FIG. 3. The beating card la in this example, as stated in the above rules of the game would be a Paper card or another Rock card with a number higher than 5. The number or points 7 on the captured card 1*c* is the one that goes into the score for the beating player A while the card 1*a* used to beat the captured card 1*c* is merely set aside and do not get into the scoring of the game. The capturing player A at this situation is winning both the chess game and the rps game with a score of 5 points. The captured chess piece 6*b* along with the captured card 1*c* is placed at an area at the lateral side of the chessboard 2, with one lateral side designated for each player. This area is referred to herein as score box 8. If the players are using a conventional chessboard, they can just designate a space at the sides of the chessboard to serve as the score box. In this example, the captured chess piece 6*b* and the captured card 1*c* is placed in score box 8*a*. If the capturing player A does not have a card 1*a* on the pit spot 3*a* to beat the card 1*c* on the center spot, at this point, the captured player B is given the chance to beat card 1*c* at the center spot 5 with the cards 1*b* at his/her pit spot 3*b*. If both do not have a card 1 on the pit spot to beat card 1*c* on the center spot, then card 1*c* gets discarded and no player gets a score on the rps game but only scores on the chess game. The designation of capturing player and captured player changes from Player A and Player B depending upon which player is performing the move.

The chess game proceeds until another chess piece 6 is captured and scoring by way of the rps game is also repeated. A player never get his or her own rps cards 1 from the chessboard 2 that are in his/her own territory. A player only gets the card 1 underneath the captured chess piece, herein, captured card 1*c* and/or the cards landed on a destination square by a chess piece 6 during a move that are not in his or her territory, herein, destination card. Those rps destination cards 1 are taken unrevealed and becomes part of the remaining cards held by the capturing player for replacing a beating card. To clarify a destination card by example, when a Bishop moves diagonally from one square to another, the rps card that is present at the destination square at the opponent player's territory where the bishop lands after a move without capturing a chess piece, that is, not under a chess piece, is a destination card. The destination card is not placed at the central spot 5 of the challenge board. The cards initially remaining at the player's hand to replace a beating card at the pit spot of the challenge board and the destination card that are also used to replace a beating card at the challenge board are collectively referred here as held cards 1*d*. If there are no more rps cards 1*d* left in the hands of the player, that player waits for a destination card. The held cards 1*d* in this card game do not get into the scoring of the game. Only the card 1*c* captured under a chess piece 6 and beaten by a card from the pit spot 3 gets into the score of the game. The steps above are repeated until a player garners the wining score on the rps game or gets into a draw or wins the chess match by a checkmate. The chess game is in a draw when any further movements by each player will not result into a checkmate. The winning score or points on the rps game is at the discretion of the players and can be any number, for example, 50 points if a shorter game is desired or more points to get a better chance of prolonging the game. If a game has to be terminated prematurely for any reason without attaining a checkmate, the player with the higher rps game points wins the game. If the chess game is a draw, the player with a higher score on the rps game wins.

The above game can be enhanced to an advance rps level for non-beginners Additional rps cards 1 are added in the advance level, three wild cards 1*e* with each having 21 points, a point higher than the highest point 20 of any label rps card and a trump card 1*f* with 22 points. These four cards, 1*e* and 1*f* are added to the 60 rps cards of the basic game, resulting into a total of 64 rps cards instead of 60 rps cards. The wild card will be represented by W while the trump card will be represented by T as shown in FIG. 2. As above, the cards 1 are shuffled before distributing half of the rps cards to each player. In this advance rps card game, each player will have 32 rps cards to start. Since these cards 1 were shuffled before distribution, the wild cards 1*e* and the trump card 1*f* can be at any player's possession. If the deck of cards to be used in the actual game will come from a portion of the decks of cards from the players, one or both players may decide not to pick or choose any or some of these wild and trump cards to keep the players guessing on the number of wild cards and trump cards being played. A player with more wild cards or trump card/s can have an edge over a player with no trump card 1*f* or less number of wild cards 1*e*. The rps game is maintained, with the only difference of having more held cards and cards with higher points. The chess and advanced rps game are played in the same manner as the basic chess and rps game described above and will not be reiterated.

Figure 5:
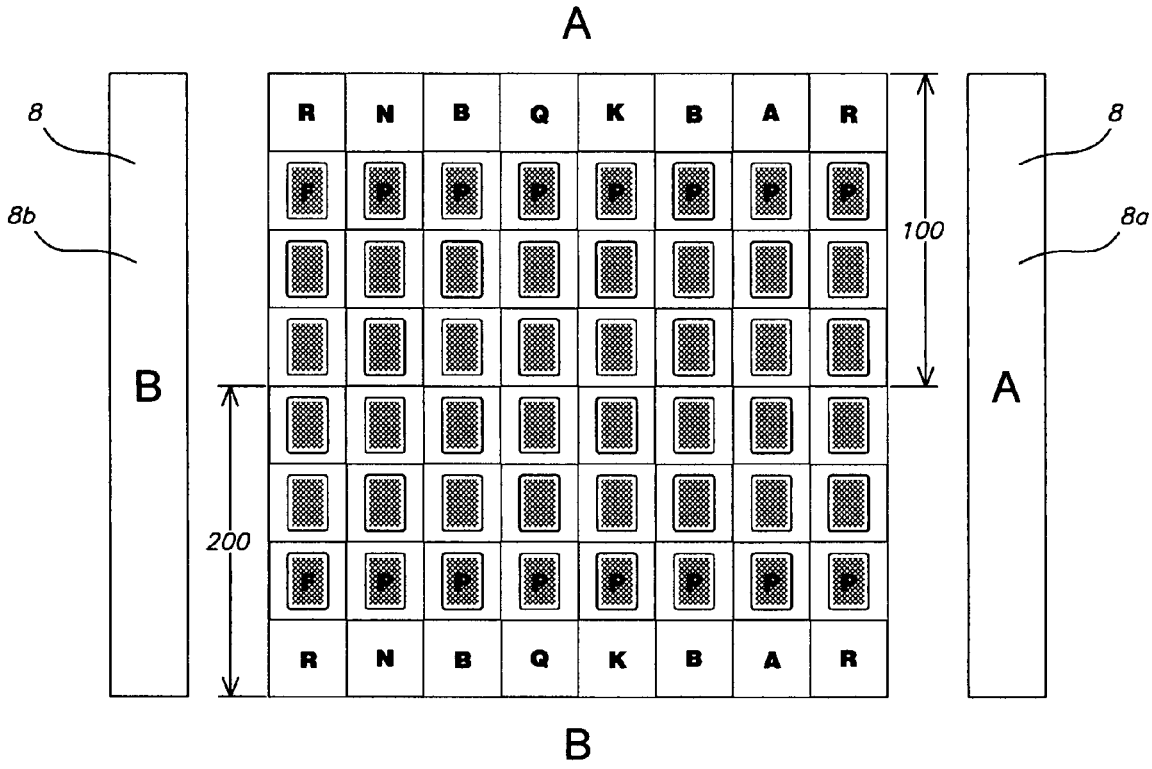
FIG. 5 is a front plan view of a chessboard showing a Frog and an Archer replacing a Pawn and a Knight.

The chess game can also be enhanced from the basic chess game by placing a new chess piece with its respective moves and manner of capturing an opponent's or another player's chess piece. In this advanced chess game, a Frog (F) chess piece 6 replaces a Pawn (P). The Frog moves like a Pawn or moves forward but not backwards as a Knight. As a Frog, it can only capture like a Pawn. The Frog replaces any Pawn at its original position on the chessboard 2 before the game starts. The Frog, however, unlike the Pawn, can not be converted into any other kind of chess piece 6 except for a Knight when it lands at any square of the chessboard along the row most proximate to the other player at the opponent player's territory. Once the Frog is converted to a Knight, it can then move and capture as a Knight. The players may choose to have more than one Frog but only one Frog is suggested to minimize the complexity of the game. This modified chess game and the rps game are played according to the same rules stated above except for the substitution of a Pawn with a Frog having its own designated movement. This advanced chess game is referred to as Frog Altered Chess Game or "facg" and this modified chess game can be played with the basic rps or advanced rps game. The Frog chess piece is represented in the chessboard with F as shown in FIG. 5.

The chess game can also be altered by replacing a Knight with an Archer. An Archer can either move like a Knight or one spot diagonally sideways. The latter move differs from that of a Bishop whose movement is not limited to one spot. However, the Archer does not capture according to its designated movement as described above but rather captures like a Rook. This modified chess game and the rps game are played according to the same rules stated above except for the substitution of a Knight with an Archer having its own designated movement. Any of the two Knights can be replaced by the Archer or both. This advanced chess game is referred to as Archer Altered Chess Game or "aacg" and this modified chess game, like the facg chess game above, can be played with the basic rps or advanced rps game. The Archer chess piece is represented with A when placed on the chessboard as shown in FIG. 5. Also, only one Archer substituting a Knight is recommended but not required.

The latter two modified chess games will unable history old chess strategies. Further, a chess game can have both facg and aacg alterations combined or incorporated into one chess game as shown in FIG. 5.

For the adult players, a Lucky Nine card game or a Texas Hold 'Em poker game, particularly the No Limit Texas Hold 'Em poker game can be combined with a chess game instead of the rps game.

The Lucky 9 game, because of the simplicity of the rules, is suited to players that do not like to learn or play the No Limit Texas Hold 'Em poker game. This game uses a standard deck of playing cards, comprising of four suits (spades, hearts, clubs and diamonds) of thirteen cards each, with each suit including one ace, one king, one queen, one jack, one ten, one nine, one eight, one seven, one six, one five, one four, one three, and one two. Cards 1-9 retains their points while the tens, Jack, Queen and King have zero points. This game is played like the rps game. However, because there are only 52 cards instead of 60 cards, each player is given 26 cards 1 after shuffling the cards. 24 of these 26 cards are placed on the chessboard 2 in the same manner as the rps cards are laid on the chessboard either randomly or by choice as shown in FIG. 4. This game also uses the challenge board 4 illustrated for the rps game shown in FIG. 3. Instead of an rps card at the central spot, it will be any captured playing card as described above. The two remaining cards are placed face down in the pit spot 3. When there is a destination card taken by a player from the other player's territory during a chess move, the destination card is placed in the pit spot until 4 cards are in the pit spot. Optionally, the players may agree on just having two cards at the pit spot. Anymore destination cards will be a held card 1*d* by the player which will be used to replace beating cards on the pit spot as in the rps game. If a player is left with no cards at his/her pit spot, that player waits until he/she gets a destination card at the other player's territory as in the rps game. When Player A captures a chess piece at Player B's territory and there is a card underneath the captured chess piece, Player A puts this captured card 1*c* at the central spot 5 of the challenge board 4. Player A will get the points on the captured card by beating the card. The captured card can be beaten by a card with the same or higher point. For example an eight card can be beaten by another eight card and by a nine card but will not be beaten by a seven or less card and the zero cards. The zero cards can be beaten by another zero card or higher. The only reason for beating a zero card is to remove the card from the central spot because zero does not affect the players' score. As in the rps game, the points or score on the beating card does not get into the scoring of the game, only the score on the beaten captured card 1*c* gets into the score. Likewise, Player B is given a chance to beat the captured card if Player A has no card in his/her pit spot to beat the captured card 1*c*. If both players do not have a card to beat the captured card, then the captured card 1*c* is discarded and no player gets a point or score from the rps game but the capturing Player A scores on the chess game. The players here also take alternate turns and designation on who is the opponent player is relative to which player is making the move. As in the rps game, the Lucky 9 game terminates when a certain number of points, pre-agreed by the players have been attained by a player. The chess, of course terminates when the chess match is at a draw or a checkmate.

Because of the popularity of the No Limit Texas Hold 'Em poker game, the adaptation of this game in combination with the chess game is described. Combination of this game with chess will provide the best option or incentive for playing chess and will provide the most challenge. Any changes from the usual No Limit Texas Hold 'Em poker game will be detailed here. The other rules remain the same and can be read, for example, at Sippets, Trevor, *The Illustrated Book of Poker and Poker Playing*, pages 116-123, Hermes House, 88-89 Blackfriars Road, London SE1 8HA, 2007. The adapted version of the No Limit Texas Hold 'Em poker game will be referred herein simply as poker game.

Figure 6:
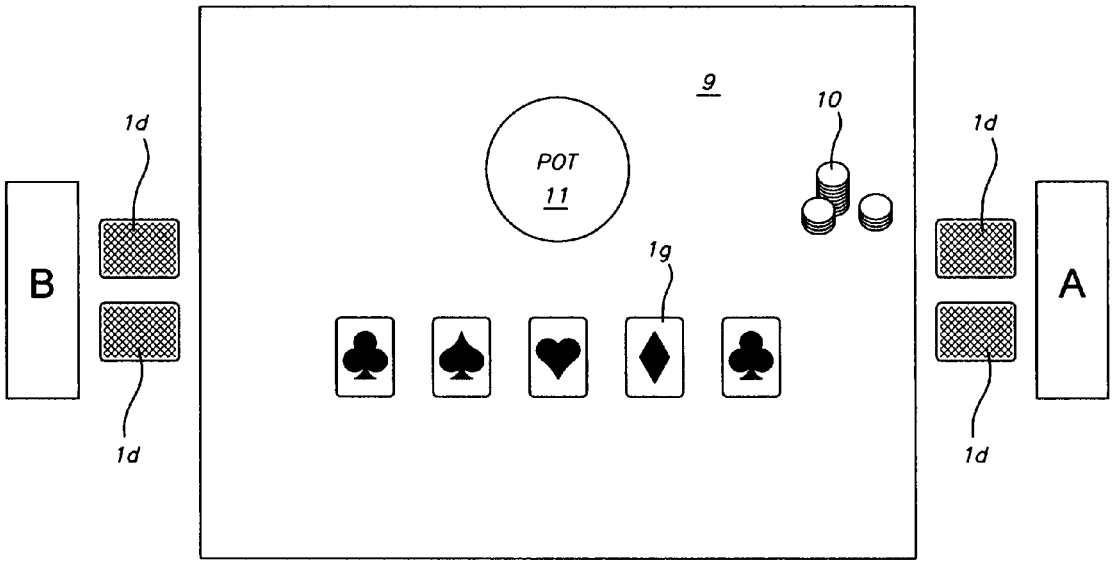
FIG. 6 shows a perspective view of a poker board with a pot having five community cards and chips near a players.

The poker game also uses the standard deck of cards used with the Lucky 9 game. There are 52 cards 1 comprising of four suits (spades, hearts, clubs and diamonds) of thirteen cards each, with each suit including (in descending rank) one ace, one king, one queen, one jack, one ten, one nine, one eight, one seven, one six, one five, one four, one three, and one two. As in the Lucky 9 game, after shuffling, each player is given 26 cards each. The player places 24 cards 1 at his/her territory on the chessboard at the same position or squares where the rps cards or Lucky 9 cards are placed as shown in FIG. 4. There will be 24 cards at territory 100 and 24 cards at territory 200. As in the other games illustrated above, the most proximate row of 8 squares are left without cards underneath the chess pieces. Only the original row of Pawns have cards underneath while the row of the other chess pieces do not. Following the rule of poker, each player retains the remaining two cards as his/her held card 1*d* and these are unrevealed. Like the conventional poker game, the player has the use of seven cards in order to form a 5 card poker hand. Two of the seven cards are held by the player while five will be community cards 1*g* that will be exposed on an open space of a table where the players are playing. These community cards are available for use by any player to form a poker hand. Instead of using an open space on the table, the players can use the back side of the challenge board 4 as a poker board 9 to place the community cards 1*g* on. A five card poker hand in rare occasions can come from the five community cards without using a held card to form the highest possible poker hand. A poker hand is ranked in conventional poker fashion: royal flush, straight flush, four of a kind, full house, flush, straight, three of a kind, two pair, one pair, and high card in descending order. The community cards 1*g* are placed face up one by one as the game progresses. Here, a round of betting occurs every after a community card 1*g* is revealed. FIG. 6 shows a poker board 9 with 5 community cards 1*g* open. During the progress of the game, the poker board can have one to five community cards. There can never be more than five community cards on the poker board.

At the start of the game, the players agree on the total number of chips 10 which corresponds to a number of points that would be played on the game by each player. Here, since there are only two players on the conventional basic chess game, the poker game being combined with the chess game is likewise played by two players. If the players choose to play a variant of the chess game having four players, then the poker game can also be played by four players. The conventional poker game is usually played by a number of players. After the players have seen their two held cards 1*d*, before having any community card 1*g* revealed, the players place their bet. This initial bet from each player is usually agreed upon. With no community cards revealed, the game of chess starts after the initial bets are placed on the pot 11. The game of chess has been described above and will not be reiterated. If there are any changes made by virtue of a different card game being played with the chess game, this will be pointed out. If the poker game has special rules different from the conventional No Limit Texas Hold 'Em poker game and the other card games, these will also be pointed out. The designation of Player A and Player B as in the descriptions used above, is mainly to clarify the game. Player A is the first player and Player B is the second player, opponent player or the other player in relations to the first Player A in the illustrations herein. The moves or acts of Player A applies equally well to Player B depending upon who is moving or capturing or betting during the course of the game. In the poker game, if Player A lands on a destination card after a move on the chess game, Player A gets the destination card that is in opponent player's territory (Player B) 200 and puts this card face up as a community card 1*g*. A round of betting starts after a community card is revealed with no betting allowed after five community cards are revealed. Since Player A was the one who placed the community card on the poker board, Player A has three options, he/she can check, bet or fold. Player A can check when no bets, compulsory or voluntary, has taken place. By checking, Player A defers a decision to bet but remains in the game. If the opponent, Player B, subsequently responds to Player A and makes a bet after Player A placed a check, Player A now has the option to call, raise or fold. If Player B decide to check also, there is no increase on the pot and the play resumes. How a player bets depends upon the strength of his/her held cards in forming a high ranking poker hand.

If Player A decide to make a bet instead of checking, in this poker game, since it is fashioned after the No Limit Texas Hold 'Em, a player can bet the minimum (as previously agreed upon) or any amount including betting all of the number of opponent's chips, that is, putting all of his/her chips that matches the total amount of the chips of the opponent into the pot 11 or all of his/her chips on hand if his/her number of chips is less than that of the opponent's and this latter option is called 'all-in'. Player A can also place a regular bet that is not all-in. In this case, Player B has the option to call, raise or fold. Just like Player A, Player B can decide to bet all-in instead of raising in response to Player A's bet. If the bet is an all-in from either Player A or Player B, and the other player is not folding, both players reveal their held cards 1*d* and wait until there are five community cards 1*g* on the board. If there are already five community cards, the player with the higher hand based on the ranking stated above gets the chips on the pot. If one player's bet is all-in and the other player folds, the player who bets all-in gets all the chips in the pot without revealing his/her held cards 1*d*.

Player A can decide to fold instead of check or bet. In this case, Player B gets all the chips on the pot 11 and all held cards 1*d* as well as the community cards 1*g* on the board are discarded. If Player A still have chips in her possession after folding, or as a general rule, if both players still have chips in their possession even after a player folds, the chess games continues until both players get two cards by capturing 2 chess pieces with cards underneath at their respective opponent's territory. Reiterating, here, destination cards are immediately placed face up as community cards 1*g*. If there are more than 5 destination cards, but both players still have less than two cards at their hand, the extra destination cards do not get into the game and are discarded. Betting on the poker game resumes only after the two players have two cards in their hands. The player who gets the first captured card after a fold will initiate the betting after the two players each gets their two held cards 1*d*. The chess game goes on and is not affected by interruptions at the poker game.

The betting on check, bet, fold, call and raise, although described using Player A as example, applies equally to Player B, when Player B gets his turn to bet. Call means a player matches another player's bet or vice-versa. Raise means one player adds more bet than what the other player placed. When Player B in the example above raises the bet placed by Player A, the poker game does not resume until Player A matches the bet of Player B. Unlike the conventional poker game, Player A can not re-raise but is only left with the option of matching the raised bet or fold. If Player A folds, then as described above, Player B gets all the chips from the pot 11 and all held cards 1*d* as well as the community cards 1*g* on the board are discarded. If Player B decide to call instead of raise, both poker and chess game proceeds without further betting/response from Player A. Player B can also decide to fold in response to Player A's bet. In this case, as in above, Player A instead of Player B gets all the chips from the pot 11 and all held cards 1*d* as well as the community cards 1*g* on the board are discarded.

As described above, when a player captures a chess piece, the capturing player substitutes his/her chess piece for the captured chess piece as described above and places the captured chess piece in his/her score box 8. If the captured chess piece is at the opponent's territory and there is a card underneath the chess piece, the capturing player gets the captured card 1*c*. This card 1*c* does not automatically become a community card 1*g*. There is a difference in treatment between the captured card and the destination card. The captured card becomes a held card if a player has less than two cards in his/her hand or the capturing player can look at the captured card 1*c* and decide either to keep this card as a held card 1*d* and pick a weaker card in his/her hand and place the weaker card on the board as a community card 1*g* or if the captured card is one that he does not like, he can immediately place the captured card 1*c* as a community card 1*g* without changing his/her held cards. After the capturing player puts the community card on the board, betting resumes as described above and the capturing player can check, bet or fold. The other player then can respond to the capturing player's bet accordingly as described above.

The poker game ends when a player bets all-in and either player loses all his/her chips. When this occurs, the chess game also ends. The player with all chips or points wins the poker game. The game also ends when the chess match ends with a draw or a check mate. The player who wins by a check mate wins the game even if he/she has less points on the poker game. In a draw, the player with more points from the poker game wins.

While the embodiments of the present invention have been described, it should be understood that various changes, adaptations, and modifications may be made therein without departing from the spirit of the invention and the scope of the claims.

I claim:

1. A method of playing a combined chess and card game comprising the steps of;

a) laying a conventional chess piece on each designated squares of a chessboard, the conventional chess pieces including 8 Pawns, a pair of Rook, a pair of Knight, a pair of Bishop, a Queen and a King;

b) designating four horizontal rows of squares on the chessboard proximal to a first player as player's territory;

c) designating remaining four horizontal rows of squares on the chessboard proximal to a second player as opponent player's territory;

d) shuffling a deck of cards of the card game;

e) placing 24 cards of the card game face down on the chessboard by each player on three horizontal rows of squares at each player's territory, leaving a row of squares most proximate to each player without a card, a row of Pawns having a card underneath each chess piece;

f) leaving at least two unrevealed cards out of the chessboard by each player, each player keeping extra cards unrevealed as held cards;

g) simultaneously playing the game of chess and the card game with each player alternating turns;

h) taking a destination card, the card on a destination square at opponent player's territory landed by a chess piece after a move on the chess game by a player, the player not taking destination cards landed at player's own territory;

l) taking the destination card to play a selective role in the game of card and taking the captured card to play a different selective role in the game of chess;

j) taking the card underneath the captured chess piece at opponent player's territory as a captured card if a card is present;

k) resuming the game after the capture;

l) treating the destination card differently from the captured card;

m) capturing as much chess pieces by each player to win the chess game;

n) outscoring an opponent player on the card game to garnish more points; and, o) ending the game by winning the chess game on a checkmate or terminating the chess game with a draw or attaining a winning score or points on the card game, the winner on the draw given to the player with more points on the card game.

2. The game of claim 1 wherein a deck of cards actually used in the card game can come from more than one decks of cards.

3. The game of claim 1 wherein the card game is a rock-paper-scissors game or a Lucky Nine game.

4. The game of claim 3 wherein the destination card from step h) is taken unrevealed as a held card for replacing a beating card, the card placed at a player's designated pit spot of a challenge board, when the beating card was used to beat the captured card.

5. The game of claim 4 further comprising the steps of waiting for a destination card when there are no more held cards to replace the beating cards at player's designated pit spot.

6. The game of claim 3 wherein the captured card from step j) is placed face up at the central spot of the challenge board.

7. The game of claim 3 wherein outscoring a player is by beating as many captured cards placed at the central spot of the challenge board with a beating card of the same or higher points from a beating player's designated pit spot, crediting the points on the captured cards but not the points on the beating card to the beating player, and placing the captured card on the beating player's score box.

8. The game of claim 7 further comprising discarding the captured card at the central spot of the challenge board when there are no beating cards from each player to beat the captured card.

9. The game of claim 3 wherein the rock-paper-scissors game comprises a set of twenty Rock cards, a set of twenty Paper cards, and a set of twenty Scissors cards, each set of twenty cards consecutively numbered from one to twenty corresponding to the points of each card with additional three Wild cards each having a point of 21 and a Trump card having a point of 22 for an advanced rock-paper-scissors game and the card game of Lucky Nine comprises a standard deck of playing cards, comprising of four suits (spades, hearts, clubs and diamonds) of thirteen cards each, with each suit including one ace, one king, one queen, one jack, one ten, one nine, one eight, one seven, one six, one five, one four, one three, and one two.

10. The game of claim 1 wherein the card game is a two player No Limit Texas Hold 'Em poker game adopted to be played with the chess game, the poker game played with a standard deck of playing cards, comprising of four suits of spades, hearts, clubs and diamonds, each suit with thirteen cards, with each suit including in descending rank, one ace, one king, one queen, one jack, one ten, one nine, one eight, one seven, one six, one five, one four, one three, and one two.

11. The game of claim 10 wherein each player places a minimum bet on a pot at a poker board after each player has seen their unrevealed held cards but before revealing any card as community card on the poker board.

12. The game of claim 11 further comprising before step n) placing the destination card taken from step h) face up at the poker board as a community card, one-by-one after a qualifying chess move as the game progresses until a maximum of five community cards are in the poker board, discarding any additional destination card when five community cards are already on the poker table; taking the captured card of step j) as a held card when both players have less than two held cards, as a replacement of an unrevealed weak held card, the weak held card placed on the poker table as a community card or as a community card; conducting a round of betting after every community card is placed face up on the poker table until after a fourth community card is placed face up, the player placing the community card starting the betting process with a check, bet, fold or all-in and opponent player responding to the bet with a check on the bet of check, a fold, a call, a raise or all-in, the bet of check available only when no bets, compulsory or voluntary has taken place; and, resuming the poker game when both players have chips to play and two unrevealed cards as held cards.

13. The game of claim 12 wherein a bet of all-in bets chips equivalent to all of opponent player's chips or points or all of player's chips or points, a bet wagers an agreed upon minimum bet, a raise increases the number of points or chips bet by opponent player, a call matches an opponent player's bet, and a fold results in opponent taking all chips at a pot on the poker board with all held cards and community cards discarded.

14. The game of claim 12 wherein a bet of all-in not responded by a fold requires all held cards to be revealed and all five community cards on the poker table to determine the player with a higher hand based on a ranking of a poker hand, the player with the higher hand taking all the chips at the pot, the ranking of the poker hand following the conventional ranking of royal flush, straight flush, four of a kind, full house, flush, straight, three of a kind, two pair, one pair, and high card in descending order.

15. The game of claim 12 wherein a bet of all-in responded by a fold does not require the player betting all-in to reveal his/her held card.

16. The game of claim 12 wherein the first player getting the first two captured card as a held card after a fold starts the round of betting when both players have two held cards.

17. The game of 12 wherein a bet of re-raise is not allowed after the opponent player raises the bet.

18. The game of claim 10 wherein outscoring a player is having as many winning five card poker hand, where each poker hand comprises two held cards and five community cards.

19. The game of claim 10 wherein attaining the winning score or points on the poker card game is getting all of opponent player's chips.

20. The game of claim 1 wherein a Pawn chess piece is replaced by a Frog chess piece, the Frog chess piece moving and capturing like a Pawn and moving forward but not backwards like a Knight until the Frog is converted to a Knight when it can then move and capture as a Knight, the Frog not convertible to any other chess piece except for a Knight when the Frog lands at any square of the chessboard along the row most proximate to the other player at opponent player's territory.

21. The game of claim 1 wherein a Knight chess piece is replaced by an Archer chess piece, the Archer chess piece moving like a Knight or one spot diagonally sideways but capturing only like a Rook.

* * * * *